United States Patent [19]

Yamasaki

[11] 4,154,285

[45] May 15, 1979

[54] GAS RELEASE METHOD IN A METAL MOLD

[76] Inventor: Koujiro Yamasaki, 3, Mifune-dori 3 Chome, Nagata-ku, Kobe, Japan

[21] Appl. No.: 850,812

[22] Filed: Nov. 11, 1977

[30] Foreign Application Priority Data

Nov. 12, 1976 [JP] Japan ..... 51-136643

[51] Int. Cl.[2] ..... B22D 17/00; B22D 17/22

[52] U.S. Cl. ..... 164/133; 164/305; 164/410

[58] Field of Search ..... 164/133, 305, 410, 113, 164/119, 284, 303, 306, 312, 133

[56] References Cited

U.S. PATENT DOCUMENTS

| | | | |
|---|---|---|---|
| 3,201,836 | 8/1965 | Nyselius | 164/312 |
| 3,447,593 | 5/1967 | Nyselius | 164/306 |

FOREIGN PATENT DOCUMENTS

| | | | |
|---|---|---|---|
| 1941908 | 3/1971 | Fed. Rep. of Germany | 164/133 |
| 471157 | 8/1975 | U.S.S.R. | 164/305 |

*Primary Examiner*—Othell M. Simpson

*Attorney, Agent, or Firm*—Holman & Stern

[57] ABSTRACT

A gas release method in a metal mold comprising two split mold half portions which have opposite inner surfaces to define a gas release path for venting the mold, in which providing a plurality of inclined surface sections along which a charge of molten metal is advanced, in heat-exchange relationship to the inner surfaces whereby the molten metal is effectively cooled and solidified so that the cross-section area of the gas release path is increased without danger of spouting of molten metal out of the gas release path.

3 Claims, 3 Drawing Figures

GAS RELEASE METHOD IN A METAL MOLD

BACKGROUND OF THE INVENTION

This invention relates to a gas release (venting) method in a metal mold comprising two split mold half portions which have opposite inner surfaces to define a release path for gases along which a charge of molten metal is advanced.

In a metal mold, generally, when a charge of molten metal at an elevated temperature (about 600° C. in case of die casting) is passed through the gas release path defined in the mold carried by the gas escaping the mold as it is filling, the molten metal immediately effects heat-exchange with the inner surface of the path upon contacting the path inner surface and the heat of the molten metal is lost to the metal mold and as a result, a thin layer of solidified metal is formed on the entire inner surface of the gas release path and the thus formed solidified metal layer which closely adheres to the path inner surface in such a manner that the layer can not be easily separated from the path inner surface and remains to cover the entire inner surface.

Even when such a layer of solidified metal has a small thickness, the film substantially hinders the transfer of heat from the molten metal to reduce the heat transfer efficiency to the degree that the cooling and solidification of the molten metal is detered. This makes it difficult to substantially increase the cross-section area of the gas release path and to reduce the distance of the path in the flow direction of the molten metal.

SUMMARY OF THE INVENTION

Therefore, one object of the present invention is to provide a gas release method in a metal mold which can effectively eliminate the disadvantage inherent in the prior art gas release methods.

Another object of the present invention is to provide a gas release method which can substantially increase the gas release efficiency, accelerate the solidification of molten metal in the gas release path and increase the cross-section area of the gas release path, to which prevent the spouting of molten metal out of the gas release path.

The above and other objects and attendant advantages of the present invention will be more readily apparent to those skilled in the art from a reading of the following detailed description in connection with the accompanying drawings which show one preferred embodiment of the present invention for illustration purpose only, but not for limiting the scope of the same in any way.

PREFERRED EMBODIMENT OF THE INVENTION

Figure 1:
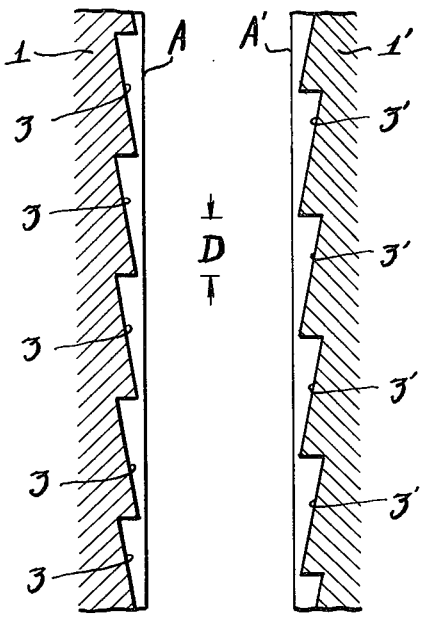
FIG. 1 is a fragmentary vertically sectional view of a metal mold in which the gas release method of the invention is carried out showing the two split mold half portions of said mold in a separated position.
Figure 2:
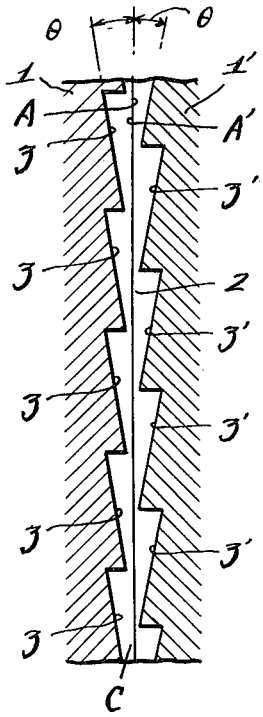
FIG. 2 is similar to FIG. 1, but also shows the two mould split half portions in their assembled position in which the gas release path is defined by the opposite saw-toothed inner surfaces of the two mould half portions.

The present invention will be now described referring to the accompanying drawings which show one preferred embodiment of the present invention for illustration purpose only, but not for limiting the same in any way.

The gas release method of the present invention will be described as being carried out in a metal mold which comprises two substantially identical split mold half portions 1, 1'. The mold split half portions 1, 1' have the saw-toothed inner surfaces A, A' each comprising a plurality of similar inclined surface sections 3, 3 . . . and 3', 3' . . . respectively, positioned in different heights in the vertical direction of the associated mold half portion. The surface sections 3, 3 . . . and 3', 3' . . . incline toward the inner surface A, A' at the same acute angle $\theta$ and have the same length as measured in the direction of the vertical axis of the cavity C in the metal mold. Each of the successive surface sections of one mold half portion is positioned at a different height with respect to each cooperating or opposite surface section of the surface sections of the other mold half portion by the distance D as measured in the direction of the vertical axis of the cavity C so as to define a zigzag gas release path 2 between the two half portions 1, 1' when assembled.

In operation, when a charge of molten metal M is caused to pass through the gas release path 2 defined by the two half portions 1, 1' in their assembled position at a high rate such as 30–50 m/sec, for example, in the arrow direction while driving gases through the path, the molten metal M first strikes against the topmost surface section 3' of the mold half portion 1' at the acute angle $\theta$ and flows along the surface section without splashing back from the surface section. The molten metal then strikes against the surface section 3 of the mold half portion 1 which is positioned opposite to the topmost surface section 3' of the mold half portion 1' in a position lower than the surface section 3' by the vertical distance D. The molten metal strikes against the opposite surface section 3 of the mold half section 1 at the same angle $\theta$ and then flows along the surface section in the same manner as the metal does along the surface section 3'. In this way, the molten metal M strikes against and flows along the successively lower positioned alternate opposite surface sections 3, 3' of the two mold half portions 1, 1' in a zigzag flow.

As mentioned hereinabove, since the successive surface sections of one mold half portion are positioned in vertical positions different from their respectively cooperating or opposite surface sections of the other mold half portion by the vertical distance D, respectively, while the molten metal M is flowing through the gas release path at a high rate, each time the molten metal moves from one surface section of one mold half portion to the lower opposite surface section of the other mold half portion, the metal does not strike against and flow along the entire latter surface section, but strikes against and flows along only a lower portion of the latter surface section and thus, the molten metal does not make contact with the remaining upper portion of the same surface section whereby the remaining upper portion of the surface section will not effect heat-exchange with the molten metal.

The particular flow pattern of the molten metal M passing through the gas release path 2 will be described referring to FIG. 3 of the accompanying drawings in which the flow pattern of the metal is shown by the arrows. In this Figure, reference character S denotes the upper portion of each surface section 3 or 3' against and along which the molten metal neither strikes nor flows and thus, which does not effect any heat-exchange with the molten metal M.

Figure 3:
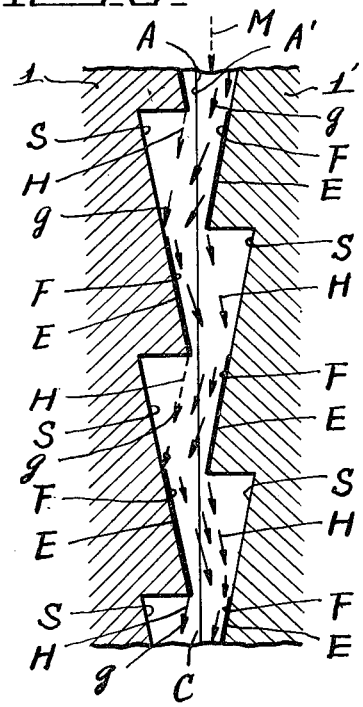
FIG. 3 is similar to FIG. 2, but also shows the flow of molten metal which is being guided along the gas release path defined by the saw-toothed surfaces of the assembled mold half portions.

In FIG. 3, the portion of each surface section 3 or 3' which effects heat-exchange with the molten metal M is shown by reference character E whilst the portion of the same surface section which does not effect heat-exchange with the molten metal is shown by reference character S, respectively. Similarly, the surface of the molten metal M which effects heat-exchange with the surface portion E of each surface section 3 or 3' is shown by reference character g whilst the surface of the molten metal which does not effect heat-exchange with the surface portion S of the same surface section is shown by reference character H, respectively.

Each time the molten metal surface g strikes against and flows along the surface portion E, the metal surface effects heat-exchange with the surface portion to solidify into a solidified layer F whilst the molten surface H does not effect heat-exchange with the surface portion S and remains in its molten phase. Thus, it will be understood that as the molten metal M flows down through the gas release path 2 in the zigzag flow as mentioned hereinabove, the opposite surfaces of the molten metal M alternately form solidified layers F, F . . . on the surface portions E which are discontinued metal layers which are separated from the same by the pressure of subsequent molten phase portions of the metal flow M and which will ultimately become separate metal strips.

Therefore, according to the present invention, although the solidified layers F are formed as the molten metal M strikes against and flows along the portions E of the successive alternate surface sections 3 and 3' of the mold two half portions 1, 1', respectively, the solidified layers F, F . . . are not connected to each other. Thus, while the molten metal flow M is advancing through the gas release path 2 forming the separate solidified layers F therein upon making contact with the successive lower alternate surface sections 3, 3' of the mold half portions 1, 1', the solidified layers F are easily separated as separate strips from the surface portions E by the remaining portion of the metal which is still in molten phase under the dynamic pressure applied to the solidified layers F by the succeeding portions of the charge of molten metal flow M and the separated solidified layers or strips F advance together with the rest of the molten metal through the gas release path 2.

As the solidified layers F are separated in the manner mentioned hereinabove, the alternate surface sections 3, 3' of the mold two half portions 1, 1' again present their portions E to the succeeding portions of the molten metal as effective discontinuous heat-exchange faces to form further discontinuous solidified layers F in the succeeding molten metal portions whereby the surface sections of the mold half portions always maintain optimum condition for heat-exchange.

By repeating the above-mentioned procedure, each time a fresh portion of the charged molten metal flows through the gas release path 2, the heat-exchange surface portions E which are maintained under optimum conditions for the purpose from the discontinuous solidified layers F in the molten metal portion which are then separated from the surface portion of gas release passage. The heat-exchange occurs on all the successive surface portions E in the same manner while increasing the amount of solidified metal strips F as the molten metal advances through the gas release path 2. The whole charge of molten metal solidifies by the time the molten metal reaches the discharge or bottom end of the gas release path 2 increasing the amount of solidified strips F therein and the flowing movement of the metal ceases upon the solidification of the whole metal.

As clear from the foregoing description of the preferred embodiment of the invention, since the molten metal advances or flows down through the zigzag gas release path 2 where the contacting surface portions E are disposed in different heights under optimum heat-exchange conditions, the molten metal can be effectively cooled whereby the cooling and solidification of the molten metal within the gas release path 2 is substantially accelerated. Therefore, even when the cross-section area of the gas release path 2 is increased so as to enhance the gas release efficiency, there is no possibility that the molten metal spouts out of the gas release path.

While only one embodiment of the invention has been shown and described in detail, it will be understood that the same is for illustration purpose only and not to be taken as a definition of the invention, reference being had for this purpose to the appended claims.

What is claimed is:

1. A gas release method in a metal mold which comprises two split half portions having opposite inner surfaces to define a zigzag gas release path therebetween which is open at the terminal end and along which a charge of molten metal is flowed, the method comprising steps of providing a plurality of similar surface sections inclined with respect the vertical axis of said gas release path at an acute angle thereto with said inclined surface sections of one inner surfaces positioned at a height different from that of the respective surface sections of the other inner surface which are respectively opposite to said surface sections of the one inner surface by a vertical distance to form a zigzag release path having an upper non-heat exchange portion and a lower heat-exchange portion and introducing said charge of molten metal along said zigzag gas release path in alternate heat-exchange contact with said heat-exchange surface portions of the surface sections of the two inner surfaces to form zigzag flow.

2. The gas release method in a metal mold as set forth in claim 1, in which solidified layers are formed in said charge of molten metal when the molten metal make contact with said heat-exchange surface portions of the surface sections of the two inner surfaces while the molten metal is flowing along said zigzag gas release path and said solidified layers are separated from the rest of the molten metal under the dynamic pressure applied thereto by the rest of the molten metal.

3. The gas release method in a metal mold as set forth in claim 1, in which said charge of molten metal is introduced at 30–50 m/sec along said zigzag gas release path.

* * * * *